US010363561B2

(12) United States Patent
Mardikian

(10) Patent No.: US 10,363,561 B2
(45) Date of Patent: Jul. 30, 2019

(54) APPARATUS FOR SHREDDING OF WASTE

(71) Applicant: Albert Mardikian, Corona Del Mar, CA (US)

(72) Inventor: Albert Mardikian, Corona Del Mar, CA (US)

( * ) Notice: Subject to any disclaimer, the term of this patent is extended or adjusted under 35 U.S.C. 154(b) by 510 days.

(21) Appl. No.: 15/001,082

(22) Filed: Jan. 19, 2016

(65) Prior Publication Data

US 2017/0203299 A1 Jul. 20, 2017

(51) Int. Cl.

| | |
|---|---|
| ***B02C 13/13*** | (2006.01) |
| ***B02C 18/00*** | (2006.01) |
| ***B02C 18/08*** | (2006.01) |
| ***B02C 18/14*** | (2006.01) |
| ***B02C 18/16*** | (2006.01) |
| ***B02C 18/22*** | (2006.01) |
| ***B02C 18/24*** | (2006.01) |

(Continued)

(52) U.S. Cl.

CPC ..... *B02C 13/13* (2013.01); *B02C 18/0084* (2013.01); *B02C 18/08* (2013.01); *B02C 18/14* (2013.01); *B02C 18/16* (2013.01); *B02C 18/2291* (2013.01); *B02C 18/24* (2013.01); *B02C 23/16* (2013.01); *B02C 23/18* (2013.01); *B02C 23/24* (2013.01); *B02C 2023/165* (2013.01)

(58) Field of Classification Search

CPC ..... B02C 23/16; B02C 2023/165; B02C 13/02–06; B02C 13/13

USPC ..... 241/73, 189.1, 275; 193/15; 198/550.01, 198/550.4, 550.5; 414/207, 299, 397

See application file for complete search history.

(56) References Cited

U.S. PATENT DOCUMENTS 1,625,554 A * 4/1927 Liggett ..... B02C 13/284 241/88.4

1,813,750 A 7/1931 Mackenzie (Continued)

FOREIGN PATENT DOCUMENTS

DE 3015523 A1 * 10/1981 ..... B02C 4/10

EP 0722486 A1 7/1996

(Continued)

OTHER PUBLICATIONS

EffEnergy; BTU Values Mar. 2006.

(Continued)

*Primary Examiner* — Shelley M Self

*Assistant Examiner* — Jared O Brown

(74) *Attorney, Agent, or Firm* — Patent Law Agency, LLC; Peter Ganjian

(57) ABSTRACT

The present disclosure provides an apparatus for shredding a pre-defined amount of waste. The apparatus includes a main frame positioned to provide support to the apparatus. Further, the apparatus includes a rotating core to shred, masticate and grind the pre-defined amount of waste. Furthermore, the apparatus includes a body mechanically linked to the main frame through a linkage plate. Moreover, the apparatus includes a hopper mounted vertically on the body. Further, the apparatus includes a first set of mash double row ball bearings symmetrically positioned near the first distal end of the main shaft. In addition, the apparatus includes a second set of mash double row ball bearings symmetrically positioned near the second distal end of the main shaft.

18 Claims, 11 Drawing Sheets

(51) Int. Cl.

| | |
|---|---|
| ***B02C 23/16*** | (2006.01) |
| ***B02C 23/24*** | (2006.01) |
| ***B02C 23/18*** | (2006.01) |

(56) References Cited

U.S. PATENT DOCUMENTS

| | | | | |
|---|---|---|---|---|
| 2,171,949 | A * | 9/1939 | Roca | B02C 18/148 222/201 |
| 2,609,993 | A * | 9/1952 | Planiol | B02C 13/1835 241/275 |
| 2,977,873 | A | 4/1961 | Crane | |
| 3,100,143 | A | 8/1963 | Doggett | |
| 3,407,510 | A | 10/1968 | Lewis et al. | |
| 3,473,494 | A | 10/1969 | Siracusa | |
| 3,506,414 | A | 4/1970 | Skendrovic | |
| 3,563,399 | A | 2/1971 | Shivers | |
| 3,707,070 | A | 12/1972 | Chaplin | |
| 3,777,680 | A | 12/1973 | Eck | |
| 3,817,259 | A | 6/1974 | Strasser et al. | |
| 3,845,220 | A | 10/1974 | Suzuki | |
| 3,945,575 | A | 3/1976 | Marsh | |
| 4,026,426 | A | 5/1977 | Shivvers | |
| 4,026,678 | A | 5/1977 | Livingston | |
| 4,046,325 | A * | 9/1977 | Tucsok | B02C 13/02 241/154 |
| 4,063,903 | A | 12/1977 | Beningson et al. | |
| 4,151,959 | A * | 5/1979 | Deister | B02C 13/06 241/185.5 |
| 4,192,746 | A | 3/1980 | Arvanitakis | |
| 4,217,061 | A | 8/1980 | Eiland et al. | |
| 4,458,428 | A | 7/1984 | Saeman | |
| 4,479,048 | A | 10/1984 | Kinoshita | |
| 4,559,720 | A | 12/1985 | Marquardt | |
| 4,565,124 | A | 1/1986 | Stautland et al. | |
| 4,644,664 | A | 2/1987 | Bradshaw | |
| 4,884,353 | A | 7/1989 | Houle | |
| 4,922,989 | A | 5/1990 | Backlund | |
| 5,001,975 | A | 3/1991 | Finden | |
| 5,105,555 | A | 4/1992 | Nakagomi | |
| 5,181,432 | A | 1/1993 | Allen | |
| 5,387,267 | A | 2/1995 | Warf | |
| 5,454,521 | A | 10/1995 | Frazier et al. | |
| 5,570,517 | A * | 11/1996 | Luker | F26B 17/20 34/136 |
| 5,651,305 | A | 7/1997 | Bushman et al. | |
| 5,743,178 | A | 4/1998 | Babbini | |
| 5,971,305 | A * | 10/1999 | Davenport | B02C 18/0084 241/197 |
| 6,089,169 | A | 7/2000 | Comiskey | |
| 6,692,544 | B1 | 2/2004 | Grillenzoni | |
| 7,252,691 | B2 | 8/2007 | Philipson | |
| 7,267,049 | B2 | 9/2007 | Babbini | |
| 7,520,457 | B1 | 4/2009 | Poitras et al. | |
| 7,521,076 | B1 | 4/2009 | Wagner | |
| D609,042 | S | 2/2010 | Wilmsen | |
| 7,993,048 | B1 | 8/2011 | Collette et al. | |
| 8,043,505 | B2 | 10/2011 | Noguchi et al. | |
| 8,714,467 | B2 * | 5/2014 | Lucas | B02C 13/00 241/188.1 |
| 9,423,178 | B2 | 8/2016 | Mardikian | |
| 2005/0274035 | A1 | 12/2005 | Beal et al. | |
| 2006/0130353 | A1 | 6/2006 | Eloo | |
| 2006/0288884 | A1 | 12/2006 | Babbini | |
| 2007/0164139 | A1 | 7/2007 | Lipowski et al. | |
| 2007/0221362 | A1 | 9/2007 | Stewart et al. | |
| 2008/0233310 | A1 | 9/2008 | Fujita | |
| 2009/0060779 | A1 | 3/2009 | Chambe et al. | |
| 2009/0090282 | A1 | 4/2009 | Gold et al. | |
| 2010/0043246 | A1 | 2/2010 | Smith | |
| 2010/0179315 | A1 | 7/2010 | Medoff | |
| 2010/0281767 | A1 | 11/2010 | Zeeck | |
| 2010/0293846 | A1 | 11/2010 | Shaffer | |
| 2010/0300368 | A1 | 12/2010 | Myers et al. | |
| 2010/0304439 | A1 | 12/2010 | Medoff | |
| 2010/0304440 | A1 | 12/2010 | Medoff | |
| 2011/0041390 | A1 | 2/2011 | Flick et al. | |
| 2011/0248109 | A1 | 10/2011 | Lesar et al. | |
| 2012/0245257 | A1 | 9/2012 | Fascio | |
| 2013/0029394 | A1 | 1/2013 | Toll et al. | |
| 2013/0205613 | A1 | 8/2013 | Mardikian | |
| 2013/0306763 | A1 * | 11/2013 | Carmel | A61L 2/07 241/17 |
| 2014/0061340 | A1 * | 3/2014 | Castronovo | B02C 19/0056 241/24.1 |
| 2014/0076693 | A1 | 3/2014 | Pankoke | |
| 2014/0144823 | A1 | 5/2014 | Marchesini et al. | |
| 2014/0166794 | A1 * | 6/2014 | Kaljunen | B02C 13/284 241/88.4 |
| 2014/0217214 | A1 * | 8/2014 | Peterson | B02C 18/145 241/86 |
| 2014/0223810 | A1 | 8/2014 | Nordin | |
| 2014/0231560 | A1 | 8/2014 | Lucas et al. | |
| 2014/0259895 | A1 | 9/2014 | Mason | |
| 2015/0276312 | A1 | 10/2015 | Mardikian | |

FOREIGN PATENT DOCUMENTS

| | | | |
|---|---|---|---|
| JP | S50158970 | A | 12/1974 |
| WO | WO-9106816 | A1 | 5/1991 |

OTHER PUBLICATIONS

Jordan Reduction Solutions ; Twin Shaft Shredders; http://www.jordanreductionsolutions.com.

http://www.kunsheng.com.tw/equipments.html website.

"Pelletizing rather than refining" ; Sun & Wind Energy, Sep. 2010; pp. 242 to 246.

WO 2004/080704 A1 ; Sep. 23, 2004 ; Atlas-Stord Denmark A/S.

Keyway—Keyseat; Nov. 29, 2014 ; Avneesh Khanna.

IAC Publishing, LLC; 2017 ; How Does Humidity Affect Static Electricity.

File Hisotry of U.S. Appl. No. 14/242,453, filed Apr. 1, 2014; Mardikian; Includes JP 550158970A.

REGREEN1-2PCT; PCT/US2016/047221 ; Filed: Aug. 16, 2016; File History, ISR, and Opinion; WO 2017/127135—dated Jul. 27, 2017.

REGREEN1-3PCT; PCT/US2016/049311 ; Filed Aug. 29, 2016; File History, ISR, and Opinion; WO 2017/127137—dated Jul. 27, 2017.

REGREEN1-4PCT; PCT/US2016/051185 ; Fled Sep. 10, 2016 ; File History, ISR, and Opinion; WO 2017/142592—dated Aug. 24, 2017.

REGREEN1-6PCT ; PCT/US2017/018513 ; Filed Feb. 17, 2017 ; File History, ISR, and Opinion ; WO2017/143293—dated Aug. 24, 2017.

WO 91/06816 A1 (AKT Consultants Pty Limited) May 16, 1991.

Australian Patent Application Office Action for Australian Patent Application: 2016388325; dated Apr. 4, 2019.

Australian Patent Application Office Action for Australian Patent Application: 2016393244; dated Apr. 4, 2019.

* cited by examiner

APPARATUS FOR SHREDDING OF WASTE

INTRODUCTION

The present disclosure relates to a field of waste management. More specifically, the present disclosure relates to an apparatus to shred waste.

In the recent years, the amount of waste has increased sharply. This increase can be attributed to factors such as increased demand and production of livestock and agricultural produce, mismanagement of livestock and agricultural produce, lack of proper waste management resources and the like. The waste primarily includes municipal waste, green waste, organic waste and the like. This waste occupies large sections of land. This waste does not decompose properly and affects the soil quality, air quality and water resource present in the vicinity. In addition, this waste is wet, has a bad odor and contains harmful bacteria. In addition, this occupancy of waste poses negative psychological impact on the neighborhood. To overcome this, the waste is shredded and grinded. In conventional treatment methods, the waste obtained from municipal dump areas is commonly transferred to multiple chambers equipped with shredding blades housed in large mechanical structures.

In one of the prior arts, an apparatus is provided for waste reduction and preparation for subsequent recycling or disposal in a self-contained system. The apparatus includes a preferably-shaped hopper for receiving organic materials to the reduced, preferably a floating auger, a solids pump and a macerator. The system preferably generates a processed organic material discharge with a particle size on the order of ⅛" without concern as to the liquid content of the incoming organic material.

In another prior art, an apparatus for recycling waste material into reusable compost is provided. The apparatus for carrying out the process includes a compact, self-contained housing having a component section and a decomposition chamber. The waste material is ground and mixed in the component section and then conveyed to the decomposition chamber by a conveyor which disperses the homogenous waste longitudinally. In addition, the homogeneous waste is dispersed laterally within the decomposition chamber. A blower directs aerating air into the decomposition chamber and the air is re-circulated back to the blower, where the re-circulated air is mixed with a predetermined amount of incoming fresh air, and a portion of the recirculating air is exhausted to atmosphere, the exhausting air being filtered prior to being exhausted. Thereafter, the resulting compost is removed by an auger through a discharge opening of the decomposition chamber.

In yet another prior art, a shredder is provided. The shredder includes a shaft which carries first and second sets of cutters. Each set of cutters is arranged around the shaft along respective helical paths. The first set of cutters is arranged to feed out material towards one end of the shaft. The second set of cutters is arranged to feed cut material towards the other end of the shaft.

These prior arts have several disadvantages. The apparatus mentioned in these prior arts have lower efficiency levels. Further, these apparatus have high fuel consumption and increased energy costs associated with inefficient operation. In addition, these apparatus requires large size of chambers for accommodating waste. This consequent space requirement poses a difficulty in transporting, assembling and placing the apparatus in operation, particularly in remote locations. In addition, these apparatus have lower grade of metals used in shredder blades and shafts that is prone to corrosion and dust. Moreover, the driving mechanism needs frequent oiling for smoother operation. Further, these apparatus are generally complex, require much manpower and are operationally uneconomical.

In light of the above stated discussion, there is a need for an apparatus that overcomes the above stated disadvantages.

SUMMARY

In an aspect, the present disclosure provides an apparatus for shredding a pre-defined amount of waste. The apparatus includes a main frame positioned to provide support to the apparatus. Further, the apparatus includes a rotating core to shred, masticate and grind the pre-defined amount of waste. Furthermore, the apparatus includes a body mechanically linked to the main frame through a linkage plate. Moreover, the apparatus includes a hopper mounted vertically on the body. Further, the apparatus includes a first set of mash double row ball bearings symmetrically positioned near the first distal end of the main shaft. In addition, the apparatus includes a second set of mash double row ball bearings symmetrically positioned near the second distal end of the main shaft. Moreover, the main frame is a metallic frame having a plurality of balance points. The rotating core is mounted on the main frame and horizontally positioned for rotation along a longitudinal axis. Further, the rotating core includes a main shaft symmetrically positioned along the longitudinal axis. Furthermore, the rotating core includes one or more shafts aligned gradually along the longitudinal axis with a first pre-defined range of angular separation. In addition, the rotating core includes one or more shaft blades adjustably mounted to the one or more shafts. The main shaft is mechanically coupled to a motor shaft of an electric motor through a radial bearing and double row mobile pulley assembly. Further, the main shaft includes a first distal end and a second distal end symmetrically from a center of the main shaft. Each shaft blade of the one or more shaft blade is positioned in a staggered orientation about the longitudinal axis. Moreover, each shaft blade of the one or more shaft blades is staggered at a second pre-defined range of angular separation. Further, a plurality of rubber spacers is positioned between the linkage plate and the main frame at each of the plurality of balance points. Moreover, the body is designed to support the rotation of the rotating core. The body includes a plurality of vertical blades mounted within the body. Further, the body includes a plurality of horizontal blades mounted on the body. Furthermore, the body includes a first cooling chamber mechanically connected to a first end of the body and a second cooling chamber mechanically connected to a second section of the body. Moreover, each of the plurality of vertical blades is curved to symmetrically contour the rotating core along a vertical axis. Each of the plurality of horizontal blades is aligned with the one or more shaft blades along a horizontal axis. The first cooling chamber and the second cooling chamber are mechanically coupled to a cooling system. Further, the hopper includes an ingress cross sectional opening to receive the pre-defined amount of waste. Moreover, the hopper includes an egress cross-sectional opening to transfer the pre-defined amount of waste inside the rotating core. The ingress cross-sectional opening of the hopper is greater than the egress cross-sectional opening of the hopper. In addition, the first set of mash double row ball bearings is enclosed in a bearing cover coincidently placed around the longitudinal axis. The second set of double row ball bearings is enclosed in the bearing cover coincidently placed around the longitudinal axis.

In an embodiment of the present disclosure, the first end is located at a mounting position of the hopper and the second end is located at the mounting position of body on the main frame.

In an embodiment of the present disclosure, the apparatus further includes a bottom lid screen housing positioned upside down and mounted on the second end of the body. In addition, a first holding hook is attached on a surface of the bottom lid screen housing and a second holding hook is attached on a surface of the hopper.

In an embodiment of the present disclosure, the main frame has a first section for holding a motor mount and a second section for holding the body.

In an embodiment of the present disclosure, the apparatus further includes a motor mount positioned adjacent to the body and mounted on a first section of the frame. The motor mount includes a plurality of holders designed to mount the electric motor and a hydraulic motor.

In an embodiment of the present disclosure, the apparatus further includes a hydraulic system installed in the apparatus. The hydraulic system is installed to vary an angle of inclination of the hopper.

In another embodiment of the present disclosure, the apparatus further includes a first hydraulic cylinder. The first hydraulic cylinder has a first holding end and a second holding end. The first holding end of the hydraulic cylinder is mechanically attached to a second holding hook of the hopper. The second holding end of the first hydraulic cylinder is mechanically coupled to a hydraulic motor.

In yet another embodiment of the present disclosure, the apparatus further includes a second hydraulic cylinder. The second hydraulic cylinder has a third holding end and a fourth holding end. The third holding end of the second hydraulic cylinder is mechanically attached to a first holding hook of the bottom lid screen housing. The fourth holding end of the first hydraulic cylinder is mechanically coupled to the hydraulic motor.

In yet another embodiment of the present disclosure, the apparatus includes a hydraulic motor mounted on a motor mount and positioned adjacent to the electric motor. The hydraulic motor is configured to pump a liquid at a pre-defined pressure inside the first hydraulic cylinder and the second hydraulic cylinder.

In an embodiment of the present disclosure, the apparatus includes a cooling system installed in the apparatus for a reduction in heat generated from the rotation of the plurality of vertical blades and the plurality of horizontal blades. Moreover, the cooling system includes an electrical pump mechanically coupled with each of a plurality of conduits and a coolant present inside each of the plurality of conduits. Each of the plurality of conduits is mechanically coupled to the first cooling chamber and the second cooling chamber of the body.

In an embodiment of the present disclosure, the apparatus further includes a grate mounted horizontally on the second end of the body. The grate is a metallic frame that has a pre-defined shape and a pre-defined size of a plurality of perforations.

In an embodiment of the present disclosure, the apparatus further includes a scraper blade designed to extend past the plurality of horizontal blades. The scraper blade is designed to have a separation of 1 inch from the plurality of horizontal blades. The scraper blade is positioned for scraping material left attached to each of the plurality of horizontal blades after shredding of the pre-defined amount of waste.

In an embodiment of the present disclosure, the apparatus further includes a first flywheel mounted at a first distal end of the main shaft. The first flywheel has a first axis coinciding with the longitudinal axis.

In an embodiment of the present disclosure, the apparatus further includes a second flywheel mounted at a second distal end of the main shaft. The second flywheel has a second axis coinciding with the longitudinal axis. The first flywheel and the second flywheel are symmetrically placed apart from the center of the main shaft. The first flywheel and the second flywheel are positioned to counter balance any abrupt change in a speed of rotation of the first shaft.

In an embodiment of the present disclosure, the first pre-defined range of angular separation is 3O-15O.

In another embodiment of the present disclosure, the second pre-defined range of angular separation is 75O-98O.

In another aspect, the present disclosure provides an apparatus for shredding a pre-defined amount of waste. The apparatus includes a main frame positioned to provide support to the apparatus. Further, the apparatus includes a rotating core to shred, masticate and grind the pre-defined amount of waste. Furthermore, the apparatus includes a body mechanically linked to the main frame through a linkage plate. Moreover, the apparatus includes a hopper mounted vertically on the body. Moreover, the apparatus includes a first flywheel mounted at a first distal end of the main shaft. In addition, the apparatus includes a second flywheel mounted at a second distal end of the main shaft. Further, the apparatus includes a first set of mash double row ball bearings symmetrically positioned near the first distal end of the main shaft. In addition, the apparatus includes a second set of mash double row ball bearings symmetrically positioned near the second distal end of the main shaft. Moreover, the main frame is a metallic frame having a plurality of balance points. The rotating core is mounted on the main frame and horizontally positioned for rotation along a longitudinal axis. Further, the rotating core includes a main shaft symmetrically positioned along the longitudinal axis. Furthermore, the rotating core includes one or more shafts aligned gradually along the longitudinal axis with a first pre-defined range of angular separation. In addition, the rotating core includes one or more shaft blades adjustably mounted to the one or more shafts. The main shaft is mechanically coupled to a motor shaft of an electric motor through a radial bearing and double row mobile pulley assembly. Further, the main shaft includes a first distal end and a second distal end symmetrically from a center of the main shaft. Each shaft blade of the one or more shaft blade is positioned in a staggered orientation about the longitudinal axis. Moreover, each shaft blade of the one or more shaft blades is staggered at a second pre-defined range of angular separation. Further, a plurality of rubber spacers is positioned between the linkage plate and the main frame at each of the plurality of balance points. Moreover, the body is designed to support the rotation of the rotating core. The body includes a plurality of vertical blades mounted within the body. Further, the body includes a plurality of horizontal blades mounted on the body. Furthermore, the body includes a first cooling chamber mechanically connected to a first end of the body and a second cooling chamber mechanically connected to a second section of the body. Moreover, each of the plurality of vertical blades is curved to symmetrically contour the rotating core along a vertical axis. Each of the plurality of horizontal blades is aligned with the one or more shaft blades along a horizontal axis. The first cooling chamber and the second cooling chamber are mechanically coupled to a cooling system. In addition, the first flywheel has a first axis coinciding with the longitudinal axis. The second flywheel has a second axis coinciding with the longitudinal axis. The first flywheel and the second flywheel are symmetrically placed apart from the center of the main shaft. The first flywheel and the second flywheel are positioned to counter balance any abrupt change in a speed of rotation of the first shaft. Further, the hopper includes ingress cross-sectional opening to receive the pre-defined amount of waste. Moreover, the hopper includes an egress cross-sectional opening to transfer the pre-defined amount of waste inside the rotating core. The ingress cross-sectional opening of the hopper is greater than the egress cross-sectional opening of the hopper. In addition, the first set of mash double row ball bearings is enclosed in a bearing cover coincidently placed around the longitudinal axis. The second set of double row ball bearings is enclosed in the bearing cover coincidently placed around the longitudinal axis.

In an embodiment of the present disclosure, the apparatus further includes a bottom lid screen housing positioned upside down and mounted on the second end of the body. In addition, a first holding hook is attached on a surface of the bottom lid screen housing and a second holding hook is attached on a surface of the hopper.

In an embodiment of the present disclosure, the apparatus further includes a grate mounted horizontally on the second end of the body. The grate is a metallic frame that has a pre-defined shape and a pre-defined size of a plurality of perforations.

In an embodiment of the present disclosure, the apparatus further includes a scraper blade designed to extend past the plurality of horizontal blades. The scraper blade is designed to have a separation of 1 inch from the plurality of horizontal blades. The scraper blade is positioned for scraping material left attached to each of the plurality of horizontal blades after shredding of the pre-defined amount of waste.

BRIEF DESCRIPTION OF THE DRAWINGS

Figure 1A:
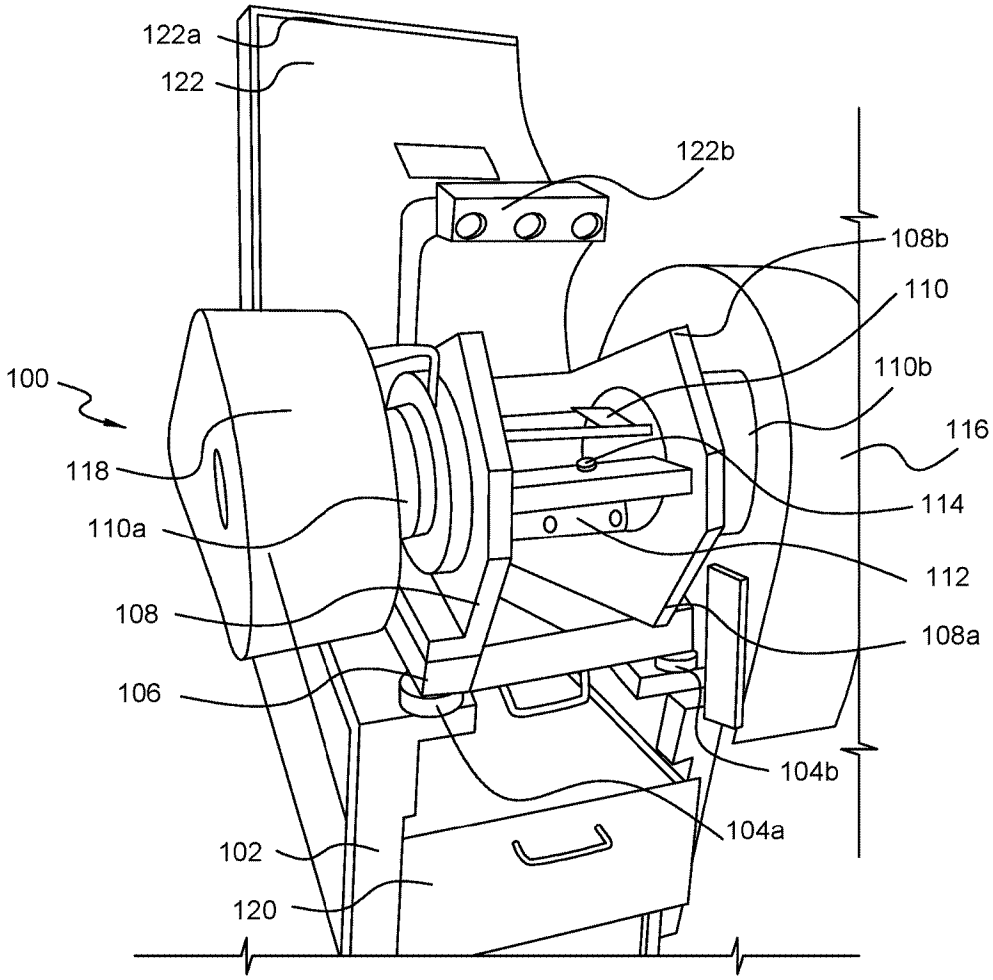
Figure 1B:
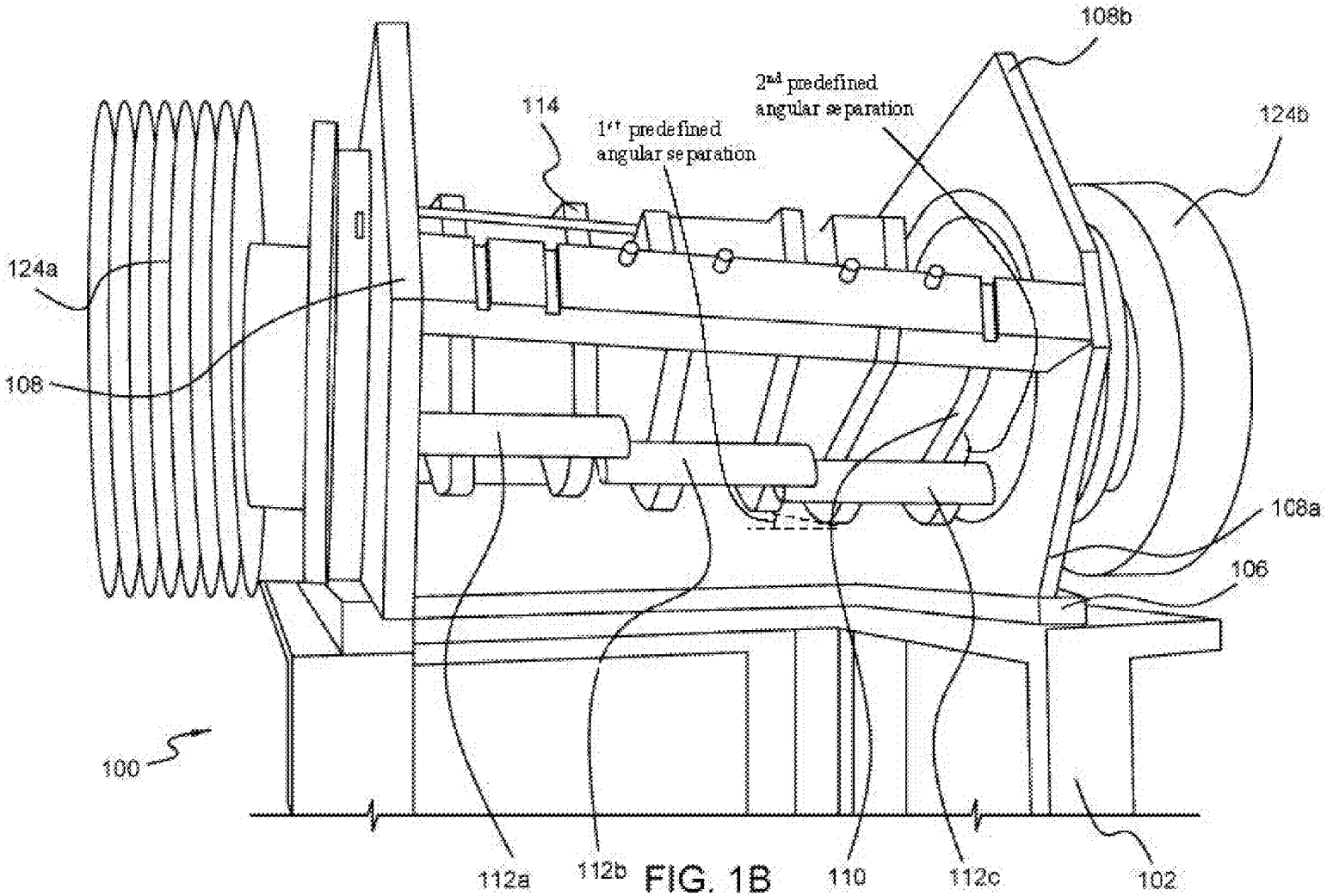
Figure 1C:
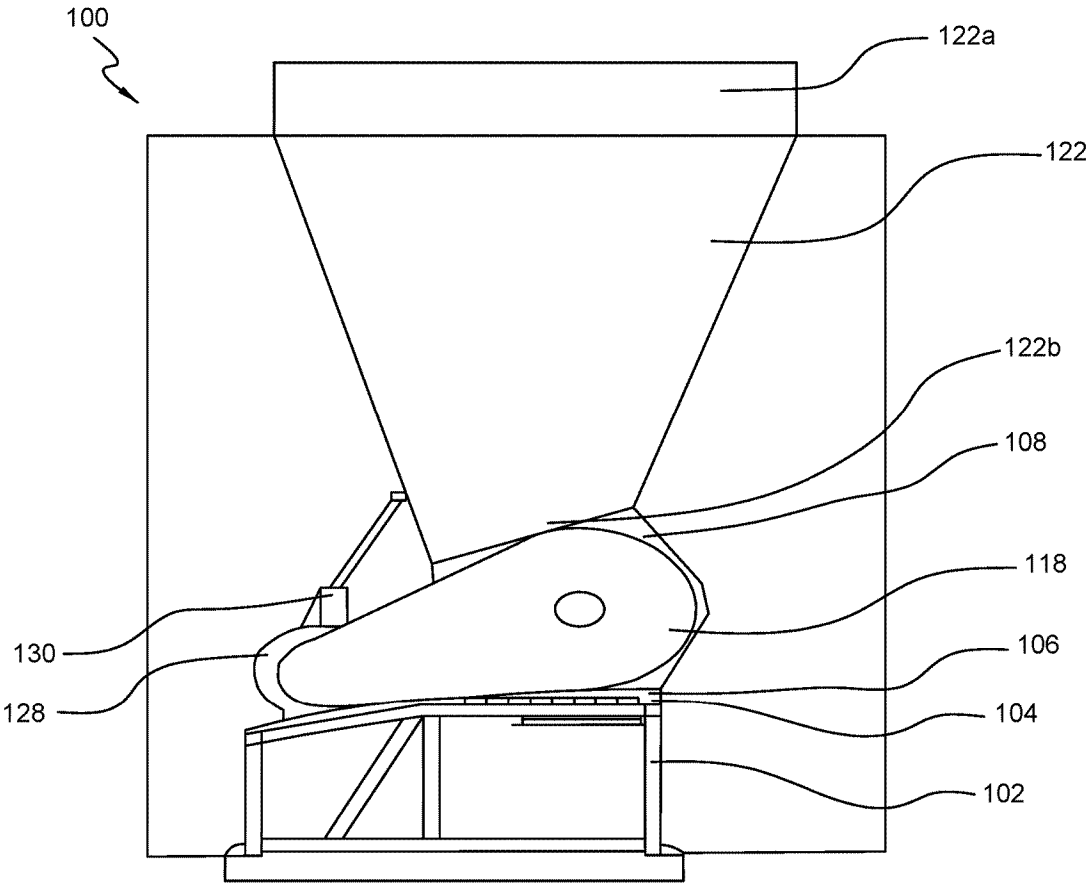
Figure 1D:
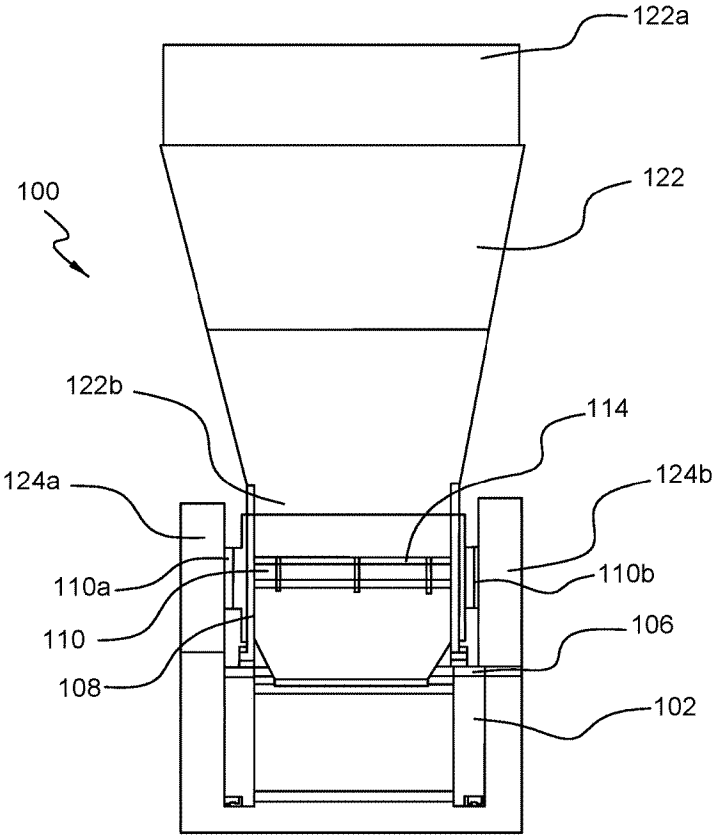
Figure 1E:
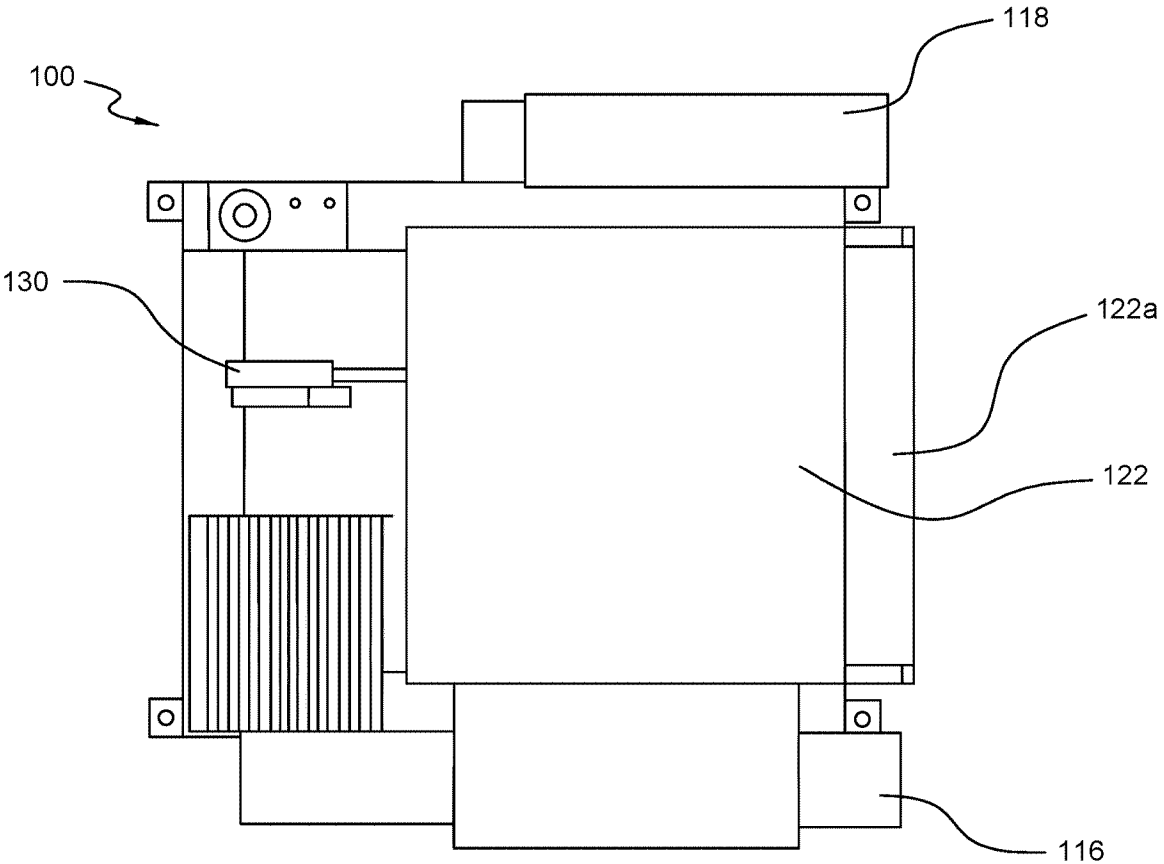
Figure 2A:
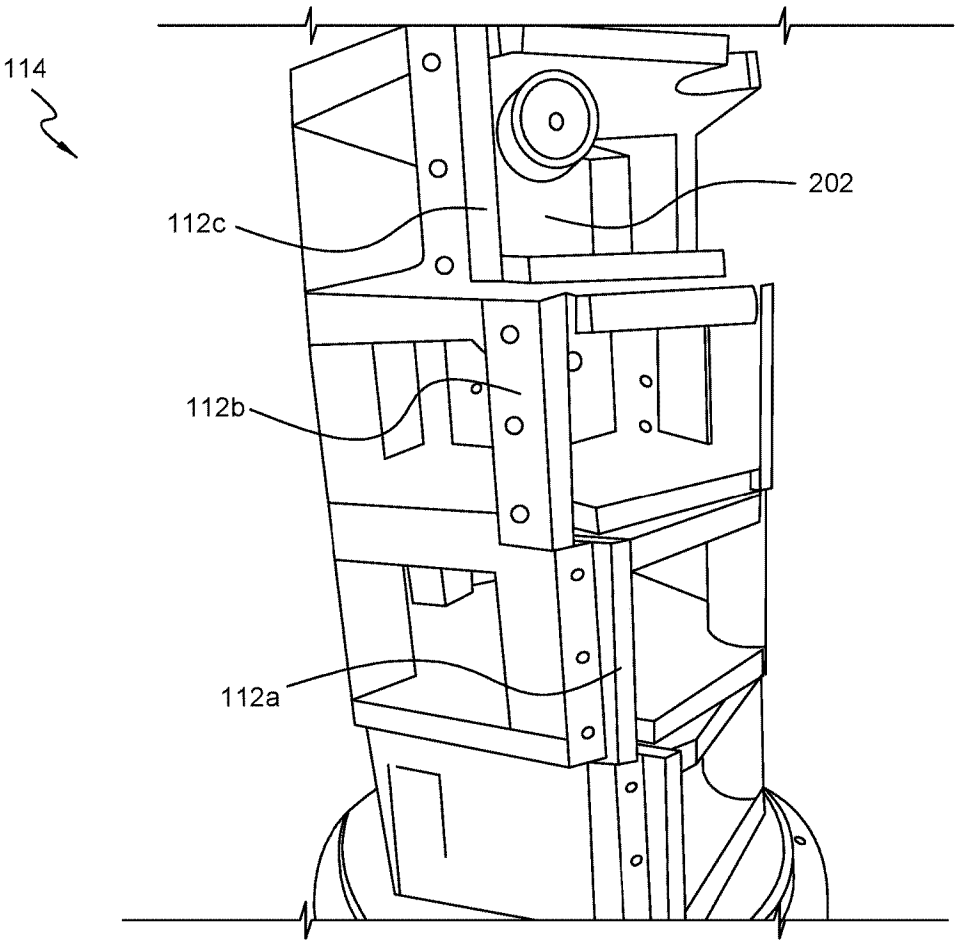
Figure 2B:
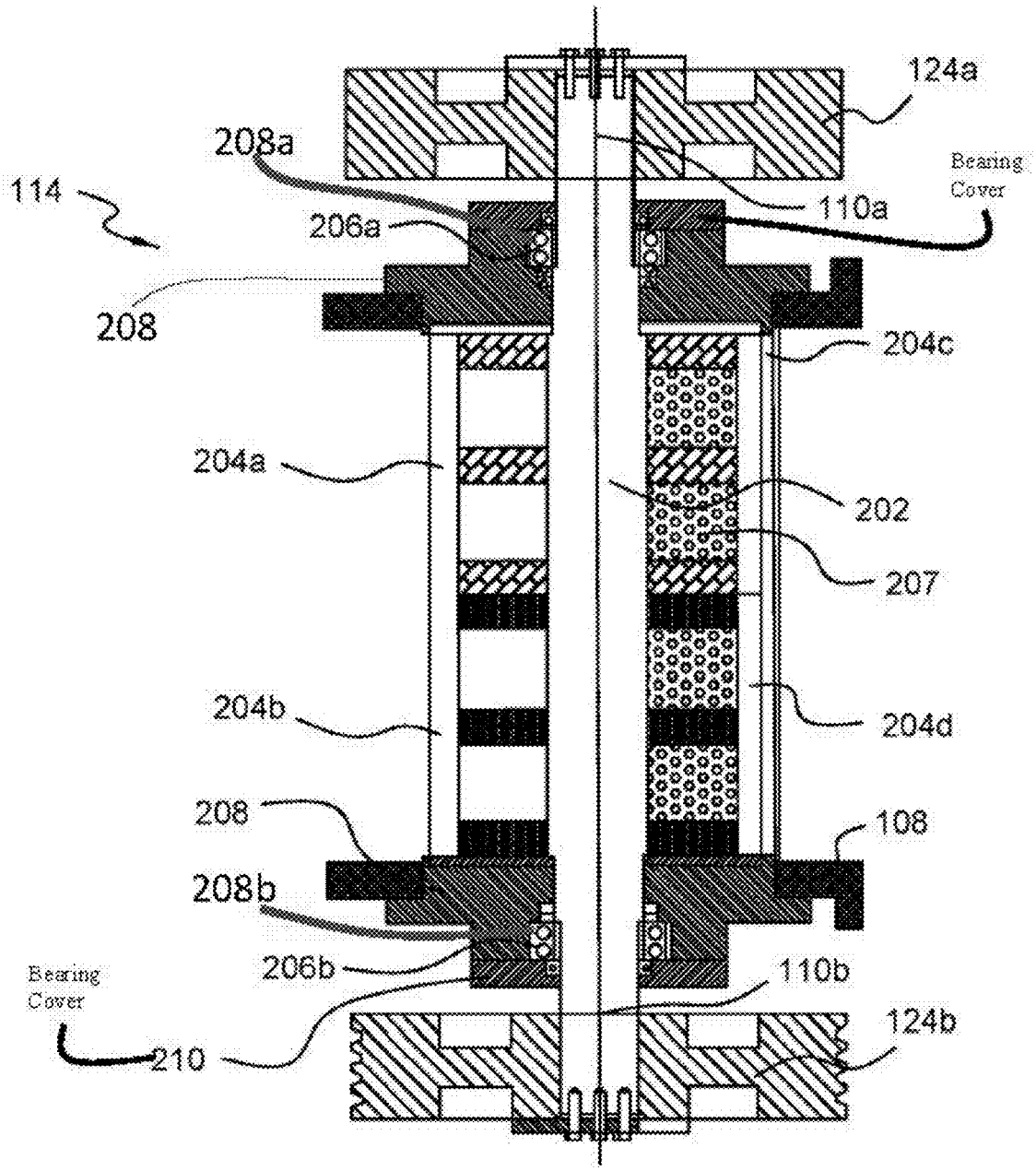
Figure 2C:
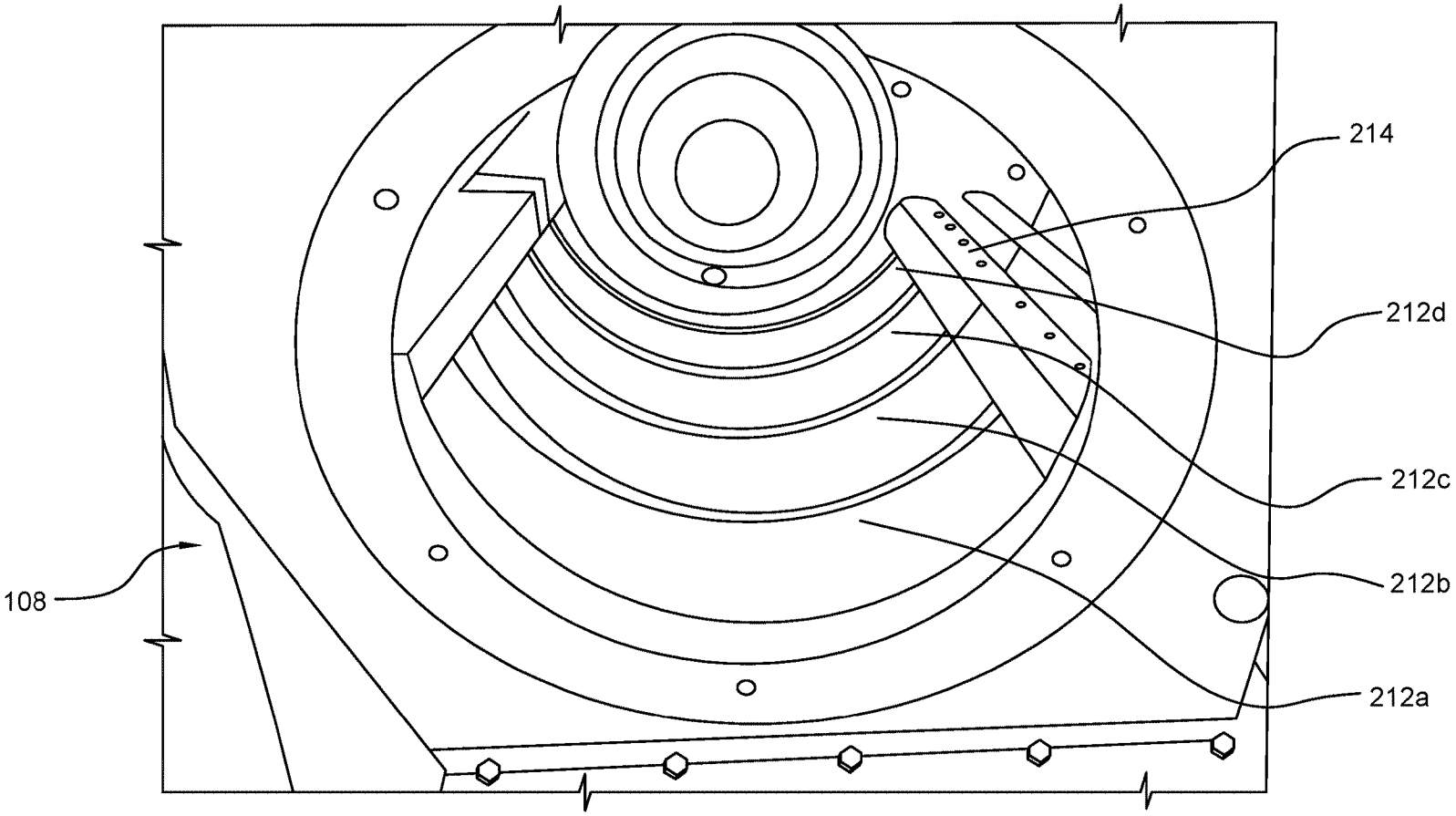
Figure 3A:
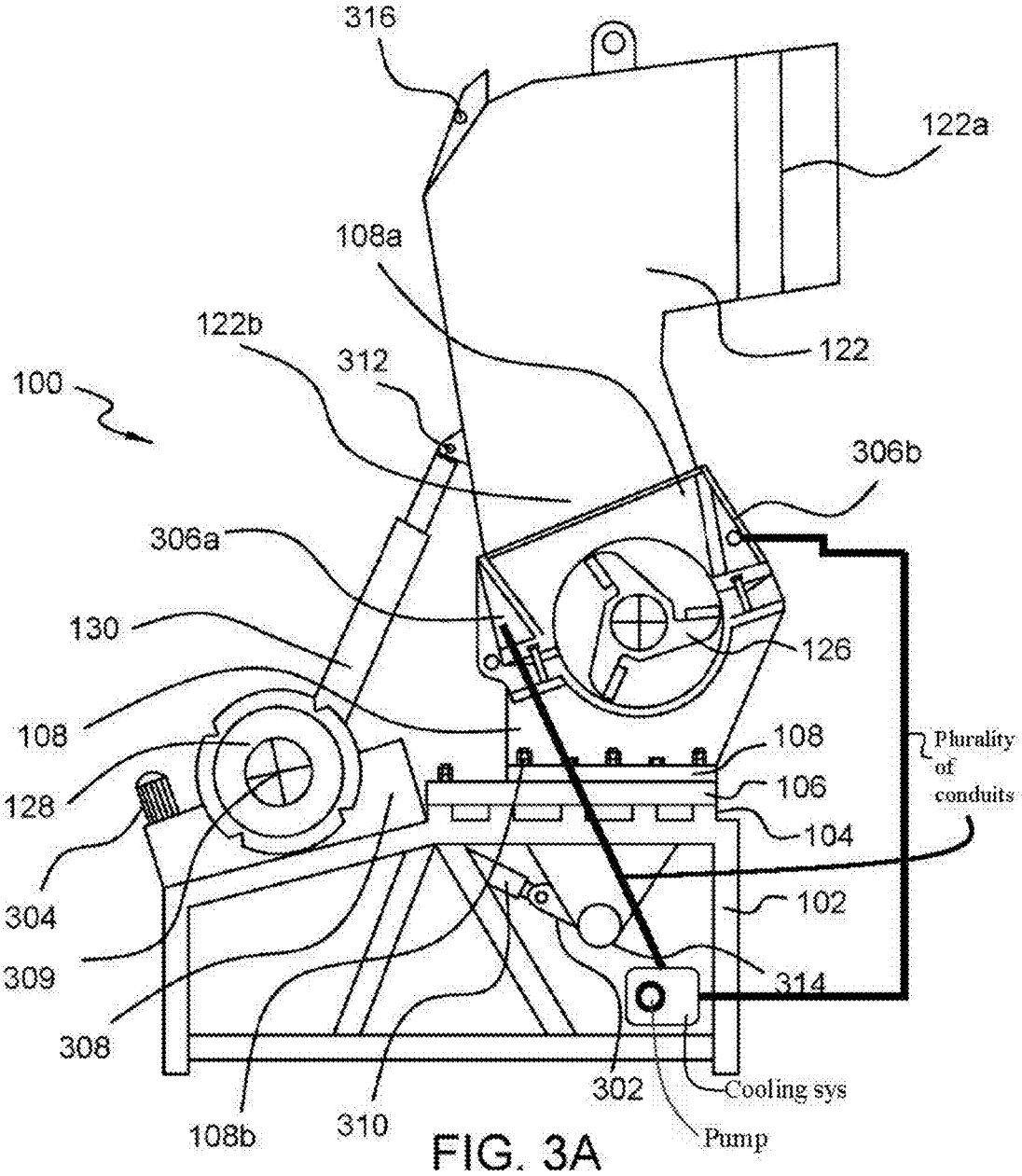
Figure 3B:
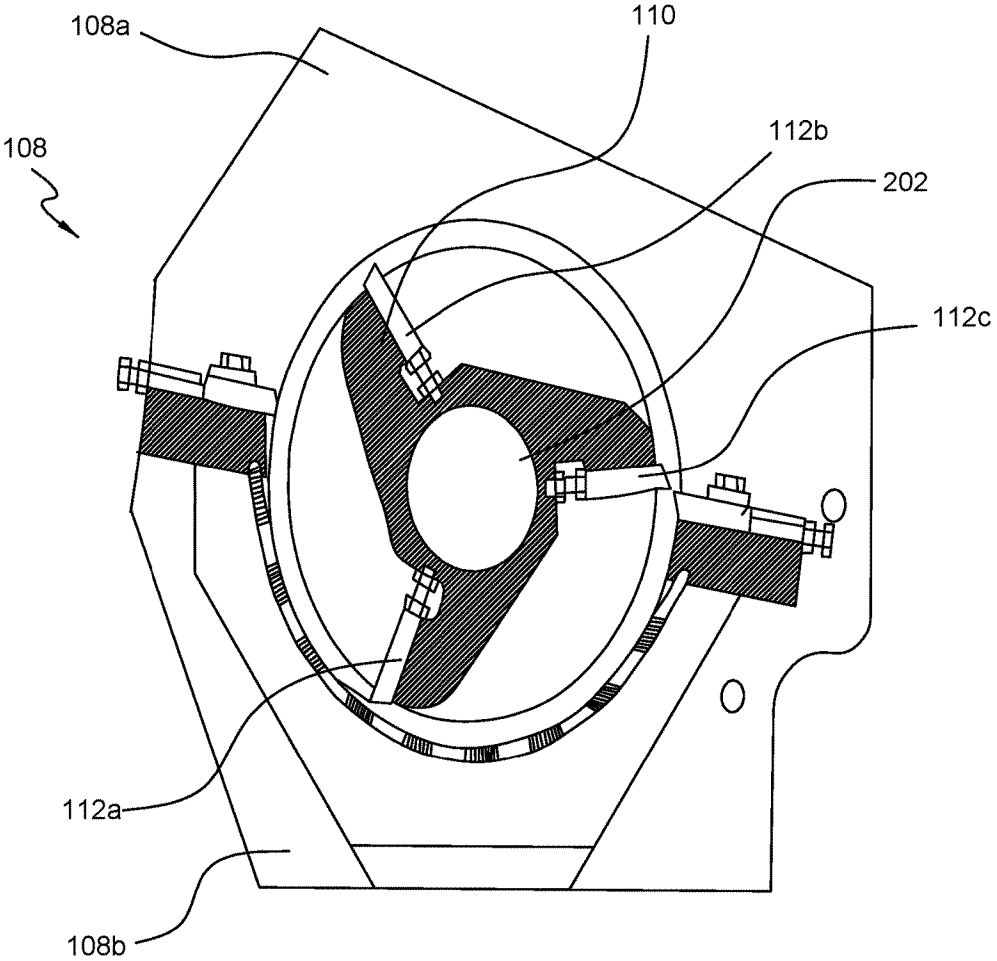
Figure 3C:
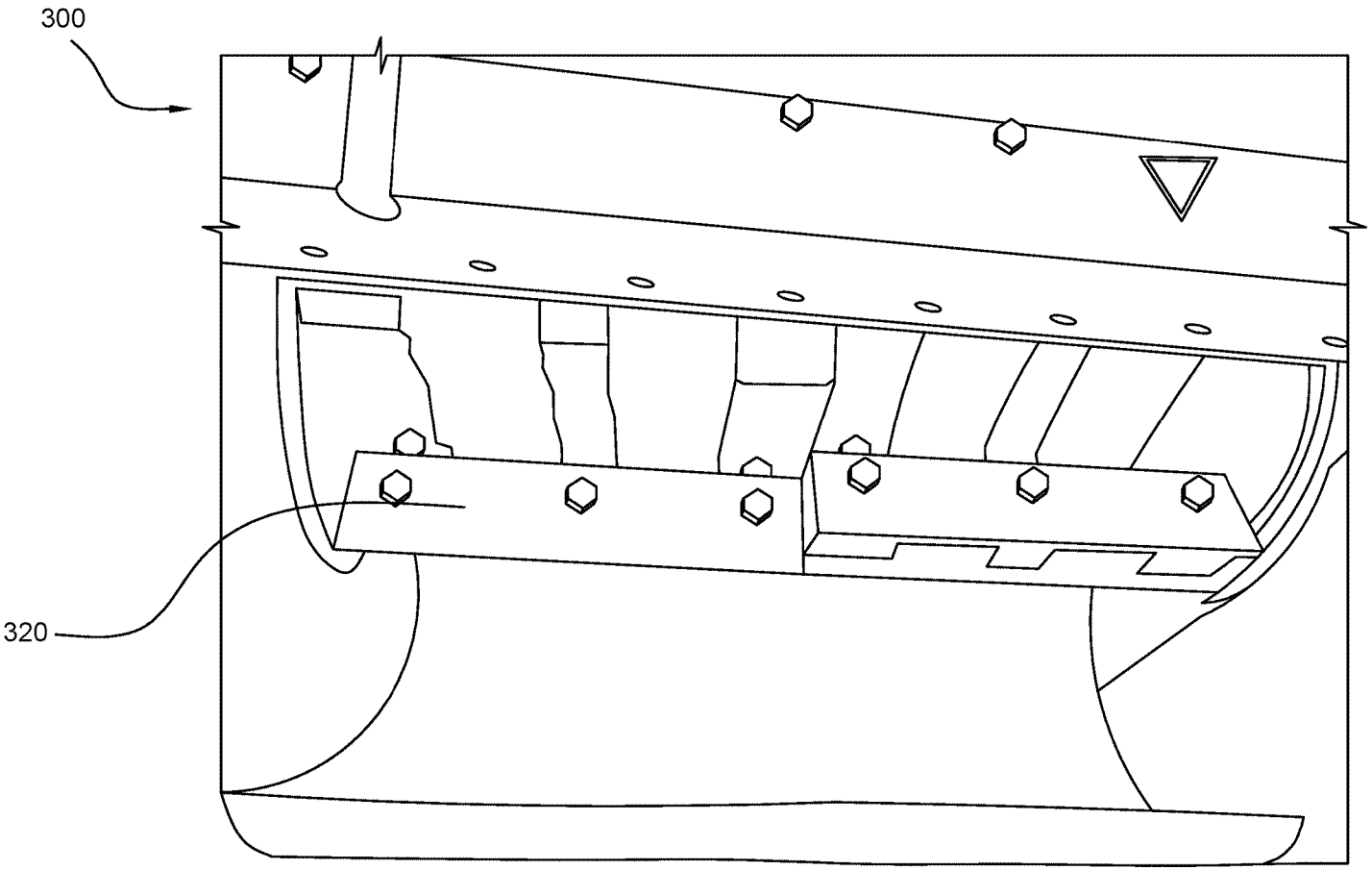

Having thus described the invention in general terms, reference will now be made to the accompanying drawings, which are not necessarily drawn to scale, and wherein:

FIG. 1A illustrates a perspective view of an apparatus for shredding of waste, in accordance with an embodiment of the present disclosure;

FIG. 1B illustrates the perspective view of the apparatus of FIG. 1A without cover, in accordance with an embodiment of the present disclosure;

FIG. 1C illustrates a side view of the apparatus of FIG. 1B, in accordance with an embodiment of the present of the present disclosure;

FIG. 1D illustrates a front view of the apparatus of FIG. 1A, in accordance with an embodiment of the present disclosure;

FIG. 1E illustrates a top view of the apparatus of FIG. 1A, in accordance with an embodiment of the present disclosure;

FIG. 2A illustrates a perspective view of a rotating core of the apparatus of FIG. 1A, in accordance with an embodiment of the present disclosure;

FIG. 2B illustrates a sectional view of the rotating core of FIG. 2A having flywheels, in accordance with an embodiment of the present disclosure;

FIG. 2C illustrates an inside view of a body of the apparatus of FIG. 1A without the rotating core, in accordance with an embodiment of the present disclosure;

FIG. 3A illustrates a schematic view and a side view of the apparatus of FIG. 1A, in accordance with an embodiment of the present disclosure;

FIG. 3B illustrates the schematic view and the side view of the body with the rotating core, in accordance with an embodiment of the present disclosure; and FIG. 3C illustrates a perspective view of a scraper assembly of the apparatus of FIG. 1A, in accordance with an embodiment of the present disclosure.

It should be noted that the accompanying figures are intended to present illustrations of exemplary embodiments of the present disclosure. These figures are not intended to limit the scope of the present disclosure. It should also be noted that accompanying figures are not necessarily drawn to scale.

DETAILED DESCRIPTION

Reference will now be made in detail to selected embodiments of the present disclosure in conjunction with accompanying figures. The embodiments described herein are not intended to limit the scope of the disclosure, and the present disclosure should not be construed as limited to the embodiments described. This disclosure may be embodied in different forms without departing from the scope and spirit of the disclosure. It should be understood that the accompanying figures are intended and provided to illustrate embodiments of the disclosure described below and are not necessarily drawn to scale. In the drawings, like numbers refer to like elements throughout, and thicknesses and dimensions of some components may be exaggerated for providing better clarity and ease of understanding.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

FIG. 1A illustrates a perspective view of an apparatus 100 for shredding of a pre-defined amount of waste, in accordance with an embodiment of the present disclosure. The apparatus 100 is a mechanical device configured to shred, masticate and grind the pre-defined amount of waste. Further, the pre-defined amount of waste is shredded based on a capacity of the apparatus 100. The pre-defined amount of waste is obtained from a plurality of sources. The pre-defined amount of waste includes waste livestock, animal excreta, municipal solid waste, green waste, organic waste and the like. In general, the pre-defined amount of waste primarily includes large solid mass of waste along with water. Further, the pre-defined amount of waste is shredded for reducing size of individual pieces of waste and removal of a pre-defined amount of water.

The apparatus 100 includes a main frame 102, a plurality of rubber spacers 104*a-b*, a linkage plate 106, a body 108, one or more shafts 110, one or more shaft blades 112, a rotating core 114, a first flywheel cover 116, a second flywheel cover 118, a collection tank 120 and a hopper 122. The above mentioned parts of the apparatus 100 are designed and assembled to shred the pre-defined amount of waste. Further, the apparatus 100 is physically supported by the main frame 102. The main frame 102 is a metallic frame positioned to provide support to the apparatus 100. Further, the main frame 102 includes a plurality of balance points. Each of the plurality of balance points is distributed discreetly across the main frame 102.

Furthermore, the linkage plate 106 is horizontally positioned on the main plate 102. In addition, the linkage plate 106 is a metallic plate designed to provide a rigid and flat base for assembled parts of the apparatus 100. The linkage plate 106 has a first plurality of holes designed to couple with a mountable part of the apparatus 100. Further, the plurality of rubber spacers 104*a-b* are inserted between each of the plurality of balance points of the main frame 102 and the linkage plate 106. Each of the plurality of rubber spacers 104*a-b* is made of a hard rubber material designed to provide a cushioning effect to the apparatus 100. In general, the apparatus 100 produces vibrations in operating mode. Further, a continuous flow of vibrations may loosen joints between the parts of the apparatus 100. In addition, each of the plurality of rubber spacers 104*a-b* is designed to absorb the vibrations produced from the operating mode.

In addition, each of the plurality of rubber spacers 104*a-b* is positioned between each of the plurality of balance points. Each of the plurality of rubber spacers 104*a-b* have a pre-defined shape. In an embodiment of the present disclosure, the pre-defined shape of each of the plurality of rubber spacers 104*a-b* is cylindrical. In another embodiment of the present disclosure, the pre-defined shape of each of the plurality of rubber spacers 104*a-b* is cuboidal. In yet another embodiment of the present disclosure, each of the plurality of rubber spacers 104*a-b* may have any suitable shape. Further, the body 108 is mechanically linked to the main frame 102 through the linkage plate 106. The body 108 includes a second plurality of holes. The first plurality of holes of the linkage plate 106 is aligned with the second plurality of holes of the body 108. Moreover, the body 108 is mechanically linked through insertion of a plurality of bolts inside an aligned first plurality of holes and the second plurality of holes.

In addition, the body 108 is aligned along a longitudinal axis. The longitudinal axis passes through a center of the rotating core 114. The body 100 includes a first end 108*a* and a second end 108*b*. Further, the body 108 has a cylindrical shape with spacing for a plurality of screens 207. Each of the plurality of screens 207 (as shown in FIG. 2B) is used to size the pre-defined amount of waste. If the pre-defined amount of waste is not divided sufficiently in a first cycle of a plurality of cycles, the apparatus 100 makes subsequent cuts to the waste to reduce size of the waste. The subsequent cut to the pre-defined amount of waste are performed to facilitate exit of the waste outside the plurality of screens 207.

As shown in FIG. 2B and FIG. 2C, the body 108 further includes a plurality of horizontal blades 204*a*-204*d*, one or more mounts 214 and a plurality of vertical blades 212*a*-212*d* respectively. Further, each of the plurality of horizontal blades 204*a*-204*d* is mounted on the one or more mounts 214 present within the body 108. In addition, each of the plurality of horizontal blades 204*a*-204*d* is aligned with the one or more shaft blades 112 along a horizontal axis. Moreover, each of the plurality of horizontal blades 204*a*-204*d* is a fixed blade designed to remain in a mounting position provided by the one or more mounts 214. In addition, the plurality of vertical blades 212*a*-212*d* is mounted within the body 108. Each of the plurality of vertical blades 212*a*-212*d* is curved to symmetrically contour the rotating core 114 along a vertical axis.

In addition, the pre-defined amount of waste is gravitationally fed to the rotating core 114. The pre-defined amount of waste is trapped between the plurality of horizontal blades 204*a*-204*d* and the plurality of vertical blades 212*a*-212*d*. The rotating core 114 tears apart the pre-defined amount of waste with each rotation.

Furthermore, the body 108 of the apparatus 100 encapsulates the rotating core 114. The rotating core 114 is configured to shred, masticate and grind the pre-defined amount of waste. Further, the rotating core 114 is positioned concentrically within the body 108 for a pre-defined speed of rotation along the longitudinal axis. As shown in FIG. 2A and FIG. 2B, the rotating core 114 includes a main shaft 202. The main shaft 202 is symmetrically positioned along the longitudinal axis. Further, the main shaft 202 is mechanically coupled to a motor shaft 309 (as shown in FIG. 3A) of an electric motor 128 (as shown in FIG. 1C and FIG. 3A) through a radial bearing and double row mobile pulley assembly. In addition, the main shaft 202 includes a first distal end 110*a* and a second distal end 110*b* symmetrically from a center of the main shaft 202.

The main shaft 202 is a cylindrical solid metallic rod. Further, one or more shafts 110 (as shown in FIG. 1B and FIG. 2A) are mounted mechanically in a staggered orientation. Each of the one or more shafts 110 are aligned gradually along the longitudinal axis with a first pre-defined range of angular separation. In an embodiment of the present disclosure, the first pre-defined range of angular separation is 3°-15°. In another embodiment of the present disclosure, the angular separation may be any acute angle. Each shaft of the one or more shafts 110 is staggered at the pre-defined range of angular separation. Further, each of the one or more shafts 110 is made from joining corners of two polygonal metallic plates with metallic bars aligned parallel to the longitudinal axis.

In addition, one or more shaft blades 112*a*-112*c* (as shown in FIG. 1B, FIG. 2A, FIG. 3A and FIG. 3B) are adjustably mounted on each of the one or more shafts 110. Further, each shaft blade of the one or more shaft blades 112*a*-112*c* is positioned in a staggered orientation about the longitudinal axis. Moreover, each shaft blade of the one or more shaft blades 112*a*-112*c* is staggered at a second pre-defined range of angular separation. In an embodiment of the present disclosure, the second pre-defined range of angular separation is 75°-98°. It may be noted that the second pre-defined range is 75°-98°, however; those skilled in the art would appreciate that the any suitable angular separation may be selected for optimized shredding of the pre-defined amount of waste.

As shown in FIG. 1B, FIG. 1D and FIG. 2D, a first flywheel 124*a* and a second flywheel 124*b* are mounted at the first distal end 110*a* and the second distal end 110*b* of the main shaft 202. Further, a first axis of the first flywheel 124*a* and a second axis of the second flywheel 124*b* coincide with the longitudinal axis. The first flywheel 124*a* and the second flywheel 124*b* are symmetrically placed apart from the center of the main shaft 202. Furthermore, the first flywheel 124*a* and the second flywheel 124*b* are positioned to counter balance any abrupt change in the pre-defined speed of rotation of the main shaft 202.

In addition, the first flywheel 124*a* and the second flywheel 124*b* are a rotational mechanical device designed to store rotational energy produced from the rotation of the main shaft 202. Further, the first flywheel 124*a* and the second flywheel 124*b* have a moment of inertia that resists any abrupt change in speed of rotation. Accordingly, the first flywheel 124*a* and the second flywheel 124*b* regulate a constant speed of rotation of the main shaft 202. The first flywheel 124*a* is associated with a first set of double row ball bearings 206*a* (as shown in FIG. 2B) and the second flywheel 124*b* is associated with a second set of double row ball bearings 206*b* (as shown in FIG. 2B). In general, the first set of double row ball bearings 206*a* and the second set of double row ball bearings 206*b* are a type of rolling-element bearings that uses one or more metallic balls for a reduction in rotational friction. The reduction in rotational friction supports radial and axial loads on the main shaft 202. Further, a first bearing race 208*a* (as shown in FIG. 2B) and a second bearing race 208*b* (as shown in FIG. 2B) encapsulates the first set of double row ball bearings 206*a* and the second set of double row ball bearings 206*b* respectively. Members 208 house the first and second bearing race 208*a* and 208*b*.

In addition, a first set of dust oil seals (as shown in FIG. 2B) and a second set of dust oil seals (as shown in FIG. 2B) are symmetrically positioned adjacent to the main shaft 202. In addition, the first set of dust oil seals and the second set of dust oil seals protect the first set of double row ball bearings 206*a* and the second set of double row ball bearings 206*b* against corrosion, dust and dirt. Further, the first flywheel 124*a* and the second flywheel 124*b* are enclosed by the first flywheel cover 116 and the second flywheel cover 118 respectively. The first flywheel cover 116 and the second flywheel cover 118 are symmetrically positioned along an axis coincident with the longitudinal axis. Moreover, the first flywheel cover 116 and the second flywheel cover 118 protect the first flywheel 124*a* and the second flywheel 124*b* against hostile environmental and operational parameters. The hostile environmental and operational parameters include device vibrations, humidity, air drag, dirt and dust.

Furthermore, the hopper 122 is vertically mounted on the second end 108*b* of the body 108. Moreover, the hopper 122 includes ingress cross-sectional opening 122*a* for reception of the pre-defined amount of waste and an egress cross-sectional opening 122*b* to transfer the pre-defined amount of waste inside the rotating core 114. In addition, the ingress cross-sectional opening 122*a* of the hopper 122 is greater than the egress cross-sectional opening 122*b* of the hopper 122. The pre-defined amount of waste enters from the ingress cross-sectional opening 122*a* and exits from the egress cross-sectional opening 122*b*. In addition, each of the plurality of screens 207 is used to size the pre-defined amount of waste.

As shown in FIG. 1C and FIG. 1E, the apparatus 100 includes the electric motor 128. In addition, the electric motor 128 is mounted on a motor mount 308 (as shown in FIG. 3A). In addition, the apparatus 100 includes a hydraulic motor 304 (as shown in FIG. 3A), a first hydraulic cylinder 130 (as shown in FIG. 1C and FIG. 3A) and a second hydraulic cylinder 310 (as shown in FIG. 3A). Further, the electric motor 128 is coupled with the motor shaft 309. The electric motor 128 is configured to rotate the rotating core 114 at the pre-defined speed of rotation. In an embodiment of the present disclosure, the electric motor 128 is a direct current based motor. In another embodiment of the present disclosure, the electric motor 128 is an alternating current motor. Moreover, the pre-defined speed of rotation of the electric motor 128 may be controlled in any manner. In an embodiment of the present disclosure, the electric motor 128 is controlled through an automatic feedback based controller. In another embodiment of the present disclosure, the electric motor 128 is controlled through a manual switch based controller.

Furthermore, the electric motor 128 and the hydraulic motor 304 are mounted on the motor mount 308. The motor mount 308 is positioned adjacent to the body 108 and mounted on a first section of the main frame 102. The motor mount 308 includes a plurality of holders designed to mount the electric motor 128 and the hydraulic motor 304. Further, a hydraulic system is installed in the apparatus 100 for varying an angle of inclination of the hopper 122.

In addition, the hydraulic system includes the hydraulic motor 304, a first hydraulic cylinder 130 and the second hydraulic cylinder 310. The hydraulic motor 304 is mounted on the motor mount 308 and positioned adjacent to the electric motor 128. The hydraulic motor 304 is configured to pump a liquid at a pre-defined pressure inside the first hydraulic cylinder 130 and the second hydraulic cylinder 310. Furthermore, the first hydraulic cylinder 130 includes a first holding end and a second holding end. The first holding end of the first hydraulic cylinder 130 is mechanically attached to a second holding hook 312 (as shown in FIG. 3A) of the hopper 122. In addition, the second holding end of the first hydraulic cylinder 130 is mechanically coupled to a hydraulic motor 304. Furthermore, the second hydraulic cylinder 310 includes a third holding end and a fourth holding end. The third holding end of the second hydraulic cylinder 310 is mechanically attached to a first holding hook 302 of a bottom lid screen housing 314 (as shown in FIG. 3A) and the fourth holding end of the second hydraulic cylinder is mechanically coupled to the hydraulic motor 304.

FIG. 2A illustrates a perspective view of the rotating core 114 of the apparatus 100, in accordance with an embodiment of the present disclosure. The rotating core 114 is configured to shred, masticate and grind the pre-defined amount of waste. The rotating core includes the main shaft 202, the one or more shafts 110 and the one or more shaft blades 112*a*-112*c* (as explained above in the detailed description of FIG. 1A and FIG. 1B).

As shown in FIG. 2B and FIG. 2C, the body 108 includes the plurality of horizontal blades 204*a*-204*d* and the plurality of vertical blades 212*a*-212*d*. In addition, the plurality of horizontal blades 204*a*-204*d* is mounted on the one or more mounts 214. Further, the plurality of vertical blades 212*a*-212*d* is mounted within the body 108. Each of the plurality of horizontal blades 204*a*-204*d* is aligned with the one or more shaft blades along a horizontal axis (as described above in detailed description of FIG. 1A).

FIG. 3A illustrates a schematic view and a side view of the apparatus 100, in accordance with an embodiment of the present disclosure. Further, the apparatus 100 includes the first holding hook 302, the hydraulic motor 308, a first cooling chamber 306*a*, a second cooling chamber 306*b* and the motor mount 308. In addition, the apparatus 100 includes the second hydraulic cylinder 310, the second holding hook 312, the bottom lid screen housing 314 and a ventilation gap 316.

The cooling system is installed in the apparatus 100 for a reduction in heat generated from the rotation of the one or more shaft blades 112*a*-112*c* and the plurality of horizontal blades 204*a*-204*d*. The cooling system includes an electrical pump mechanically coupled with each of a plurality of conduits. In addition, a coolant is present inside each of the plurality of conduits. Each of the plurality of conduits is mechanically coupled to the first cooling chamber 306*a* and the second cooling chamber 306*b* of the body 108. Moreover, the first cooling chamber 306*a* is mechanically connected to a first section of the body 108. Further, the second cooling chamber 306*b* is mechanically connected to a second section of the body 108.

Furthermore, the bottom lid screen housing 314 is positioned upside down and mounted on the second end 108*b* of the body 108. The first holding hook 302 is attached on a surface of the bottom lid screen housing 314 and the second holding hook 312 is attached on a surface of the hopper 122. The bottom lid screen housing 314 covers the collection tank 120 to protect the apparatus 100 against the environmental and operational parameters. In addition, the apparatus 100 includes a grate mounted horizontally on the second end 108*b* of the body 108. The grate is a metallic frame having a pre-defined shape and a pre-defined size. In addition, the metallic frame of the grate includes a plurality of perforations. The grate filters the pre-defined amount of waste based on size of corresponding parts.

As shown in FIG. 3C, the apparatus 100 includes a scraper assembly 300 that houses a scraper blade 320. The scraper blade 320 is designed to extend past the one or more shaft blades 112*a*-112*c*. The scraper blade 320 is designed to have a separation of 1 inch from the plurality of horizontal blades 204*a*-204*d*. The scraper blade 320 is positioned for scraping material left on a perforated screen after shredding of the pre-defined amount of waste. Moreover, the ventilation gap 316 is an opening designed near the ingress cross-sectional opening of the hopper 122. The ventilation gap 316 removes heat and gases evolved in the shredding of the pre-defined amount of waste.

Further, the present apparatus has several advantages over the prior art. The present apparatus provides a compact and sophisticated shredding and grinding of the waste with an increased processing efficiency. Further, the apparatus derives a lower power with an increased output. Thus, the apparatus provides a higher return of investment and an easier finance of resources. Furthermore, the use of the apparatus has a various ecological benefits. The apparatus grinds the waste and removes a certain amount of water. The processed waste is dehydrated and covers lower area. In addition, the apparatus reduces the size of the waste from coarse to a finer and homogeneous blend. This decreases the overall volume of the waste initially fed inside the apparatus significantly. In addition, the apparatus provides a solution to the growing problem of large scale waste dumping.

The foregoing descriptions of specific embodiments of the present technology have been presented for purposes of illustration and description. They are not intended to be exhaustive or to limit the present technology to the precise forms disclosed, and obviously many modifications and variations are possible in light of the above teaching. The embodiments were chosen and described in order to best explain the principles of the present technology and its practical application, to thereby enable others skilled in the art to best utilize the present technology and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present technology.

While several possible embodiments of the invention have been described above and illustrated in some cases, it should be interpreted and understood as to have been presented only by way of illustration and example, but not by limitation. Thus, the breadth and scope of a preferred embodiment should not be limited by any of the above-described exemplary embodiments.

What is claimed is:

1. An apparatus for shredding a pre-defined amount of waste, the apparatus comprising:

a main frame that supports a body of the apparatus, wherein the main frame having a plurality of balance points and the body including a single through-chamber for shredding waste;

a single rotating core for shredding, masticating and grinding the pre-defined amount of waste, the rotating core is mounted on the main frame and is horizontally positioned for rotation along a longitudinal axis of the rotating core, the rotating core comprising:

a single main shaft symmetrically positioned along the longitudinal axis of the rotating core, the main shaft is mechanically coupled to a motor shaft of an electric motor through a radial bearing and double row mobile pulley assembly, such that the main shaft includes a first and a second flywheel;

the main shaft comprises a first distal end and a second distal end symmetrically distanced from a center of the main shaft;

one or more support blocks radially extended to form an exterior surface of the rotating core, and the one or more support blocks radially extended to form an exterior surface of the rotating core, and the one or more support blocks are transverse to the longitudinal axis of the rotating core and are aligned along the longitudinal axis of the rotating core with a gradual first pre-defined range of angular separation; and one or more blades adjustably mounted to a mounting surface of the one or more support blocks, each blade of the one or more blade is positioned in a staggered orientation about the longitudinal axis of the rotating core and each blade of the one or more blade is staggered at a second pre-defined range of angular separation;

the body is mechanically linked to the main frame through a linkage plate, the linkage plate is horizontally positioned on a main plate, and includes a plurality of openings;

a plurality of rubber spacers are positioned between the linkage plate and the main frame at each of the plurality of balance points the body is configured to support the rotation of the rotating core, the body comprising:

a plurality of vertical blades mounted within the body, wherein each of the plurality of vertical blades is curved to symmetrically contour the rotating core along a vertical axis;

a plurality of horizontal blades mounted on the body, wherein each of the plurality of horizontal blades being aligned with the one or more shaft blades along a horizontal axis;

a first cooling chamber mechanically connected to a first end of the body; and a second cooling chamber mechanically connected to a second end of the body, wherein the first cooling chamber and the second cooling chamber being mechanically coupled to a cooling system;

a hopper mounted vertically mounted on the body, wherein the hopper comprises an ingress cross-sectional opening for receiving the pre-defined amount of waste, and an egress cross-sectional opening for transferring the pre-defined amount of waste inside the rotating core and wherein the ingress cross-sectional opening of the hopper is wider than the egress cross-sectional opening of the hopper;

a first set of mash double row ball bearings symmetrically positioned near the first distal end of the main shaft, wherein the first set of mash double row ball bearings being enclosed in a first bearing cover coincidently placed around the longitudinal axis; and a second set of mash double row ball bearings symmetrically positioned near the second distal end of the main shaft, wherein the second set of double row ball bearings being enclosed in a second bearing cover coincidently placed around the longitudinal axis.

2. The apparatus as recited in claim 1, wherein the first end being located at a mounting position of the hopper and the second end being located at the mounting position of the body on the main frame.

3. The apparatus as recited in claim 1, further comprising a bottom lid screen housing positioned upside down and mounted on the second end of the body, wherein a first holding hook being attached on a surface of the bottom lid screen housing and a second holding hook being attached on a surface of the hopper.

4. The apparatus as recited in claim 1, wherein the main frame has a first section for holding a motor mount and a second section for holding the body.

5. The apparatus as recited in claim 1, further comprising a motor mount positioned adjacent to the body and mounted on a first section of the frame, wherein the motor mount comprises a plurality of holders adapted to mount the electric motor and a hydraulic motor.

6. The apparatus as recited in claim 1, further comprising a hydraulic system installed in the apparatus, wherein the hydraulic system being installed for varying an angle of inclination of the hopper.

7. The apparatus as recited in claim 6, wherein:

the hydraulic system, includes:

a first hydraulic cylinder having a first holding end and a second holding end, wherein the first holding end of the first hydraulic cylinder being mechanically attached to a second holding hook of the hopper and the second holding end of the first hydraulic cylinder being mechanically coupled with a hydraulic motor.

8. The apparatus as recited in claim 7, wherein:

the hydraulic system further includes:

a second hydraulic cylinder having a third holding end and a fourth holding end, wherein the third holding end of the second hydraulic cylinder being mechanically attached to a first holding hook of a bottom lid screen housing and the fourth holding end of the first hydraulic cylinder being mechanically coupled with a hydraulic motor.

9. The apparatus as recited in claim 6, further comprising a hydraulic motor mounted on a motor mount and positioned adjacent to the electric motor and wherein the hydraulic motor being configured to pump a liquid at a pre-defined pressure inside the first hydraulic cylinder and the second hydraulic cylinder.

10. The apparatus as recited in claim 1, wherein: the cooling system installed in the apparatus for a reduction in heat generated from the rotation of the plurality of vertical blades and the plurality of horizontal blades, wherein the cooling system comprises an electrical pump mechanically coupled with each of a plurality of conduits and a coolant present inside each of the plurality of conduits, wherein each of the plurality of conduits being mechanically coupled to the first cooling chamber and the second cooling chamber of the body.

11. The apparatus as recited in claim 1, further comprising a screen mounted horizontally on the second end of the body, wherein the screen being a metallic frame having a pre-defined shape and a pre-defined size of a plurality of perforations.

12. The apparatus as recited in claim 1, further comprising a scraper blade configured to extend past the plurality of horizontal blades, wherein the scraper blade being configured to have a separation of 1 inch from the plurality of horizontal blades and wherein the scraper blade being positioned for scraping material left attached to each of the plurality of horizontal blades after shredding of the pre-defined, amount of waste.

13. The apparatus as recited in claim 1, wherein the first pre-defined range of angular separation being 3°-15°.

14. The apparatus as recited in claim 1, wherein the second pre-defined range of angular separation being 75°-98°.

15. An apparatus for shredding a pre-defined amount of waste, the apparatus comprising:

a main frame that supports a body of the apparatus, wherein the main frame being a metallic frame having a plurality of balance points; the body including a single through-chamber for shredding waste a single rotating core for shredding, masticating and grinding the pre-defined amount of waste, the rotating core is mounted on the main frame and is horizontally positioned for rotation along a longitudinal axis of the rotating core, the rotating core comprising:

a single main shaft symmetrically positioned along the longitudinal axis of the rotating core, the main shaft is mechanically coupled to a motor shaft of an electric motor through a radial bearing and double row mobile pulley assembly, such that the main shaft includes a first and a second flywheel;

the main shaft comprises a first distal end and a second distal end symmetrically distanced from a center of the main shaft;

the rotating core further comprising:

one or more support blocks radially extended to form an exterior surface of the rotating core, and the one or more support blocks are transverse to the longitudinal axis of the rotating core and are aligned along the longitudinal axis of the rotating core with a gradual first pre-defined range of angular separation; and one or more blades adjustably mounted to the one or more support blocks, each blade of the one or more blade is positioned in a staggered orientation about the longitudinal axis of the rotating core and each blade of the one or more blade is staggered at a second pre-defined range of angular separation;

the body is mechanically linked to the main frame through a linkage plate, the linkage plate is horizontally positioned on a main plate, and includes a plurality of openings;

a plurality of rubber spacers are positioned between the linkage plate and the main frame at each of the plurality of balance points, the body is configured to support the rotation of the rotating core, the body comprising:

a plurality of vertical blades mounted within the body, wherein each of the plurality of vertical blades is curved to symmetrically contour the rotating core along a vertical axis;

a plurality of horizontal blades mounted on the body, wherein each of the plurality of horizontal blades being aligned with the one or more shaft blades along a horizontal axis;

a first cooling chamber mechanically connected to a first end of the body; and a second cooling chamber mechanically connected to a second end of the body, wherein the first cooling chamber and the second cooling chamber being mechanically coupled to a cooling system;

the first flywheel mounted at a first distal end of the main shaft, wherein the first flywheel has a first axis coinciding with the longitudinal axis;

the second flywheel mounted at a second distal end of the main shaft, wherein the second flywheel has a second axis coinciding with the longitudinal axis, wherein the first flywheel and the second flywheel are symmetrically placed apart from the center of the main shaft and wherein the first flywheel and the second flywheel are positioned to counter balance any abrupt change in a speed of rotation of the first shaft;

a hopper mounted vertically mounted on the body, wherein the hopper comprises an ingress cross-sectional opening for receiving the pre-defined amount of waste, and an egress cross-sectional opening for transferring the pre-defined amount of waste inside the rotating core and wherein the ingress cross-sectional opening of the hopper is wider than the egress cross-sectional opening of the hopper;

a first set of mash double row ball bearings symmetrically positioned near the first distal end of the main shaft, wherein the first set of mash double row ball bearings being enclosed in a bearing cover coincidently placed around the longitudinal axis; and a second set of mash double row ball bearings symmetrically positioned near the second distal end of the main shaft, wherein the second set of double row ball bearings being enclosed in a second bearing cover coincidently placed around the longitudinal axis.

16. The apparatus as recited in claim 15, further comprising a bottom lid screen housing positioned upside down and mounted on the second end of the body, wherein a first holding hook being attached on a surface of the bottom lid screen housing and a second holding hook being attached on a surface of the hopper.

17. The apparatus as recited in claim 15, further comprising a screen mounted horizontally on the second end of the body, wherein the screen being a metallic frame having a pre-defined shape and a pre-defined size of a plurality of perforations.

18. The apparatus as recited in claim 15, further comprising a scraper blade configured to extend past the plurality of horizontal blades, wherein the scraper blade adapted to have a separation of 1 inch from the plurality of horizontal blades and wherein the scraper blade being positioned for scraping material left attached to each of the plurality of horizontal blades after shredding of the pre-defined amount of waste.

* * * * *